US012702187B1

(12) United States Patent
Ding et al.

(10) Patent No.: US 12,702,187 B1
(45) Date of Patent: Aug. 11, 2026

(54) WATERPROOF, BREATHABLE, AND SHOCK-ABSORBING SHOE SOLE

(71) Applicant: MAOTAI (FUJIAN) NEW MATERIAL TECHNOLOGY CO., LTD, Jinjiang (CN)

(72) Inventors: Sien Ding, Jinjiang (CN); Rongda Zheng, Jinjiang (CN); Weizhi Zhuang, Jinjiang (CN)

(73) Assignee: MAOTAI (FUJIAN) NEW MATERIAL TECHNOLOGY CO., LTD, Jinjiang (CN)

( * ) Notice: Subject to any disclaimer, the term of this patent is extended or adjusted under 35 U.S.C. 154(b) by 0 days.

(21) Appl. No.: 19/365,861

(22) Filed: Oct. 22, 2025

(30) Foreign Application Priority Data

Jul. 2, 2025 (CN) ..... 202521378667.5

(51) Int. Cl.
*A43B 7/08* (2022.01)
*A43B 13/18* (2006.01)

(52) U.S. Cl.
CPC ..... *A43B 7/082* (2013.01); *A43B 7/088* (2013.01); *A43B 13/184* (2013.01)

(58) Field of Classification Search
CPC .. A43B 7/06; A43B 7/08; A43B 7/081; A43B 7/082; A43B 7/084; A43B 7/087; A43B 7/088; A43B 13/125; A43B 13/181; A43B 13/184; A43B 13/206; A43B 13/25; A43B 5/08
USPC ..... 36/3 B, 8.1
See application file for complete search history.

(56) References Cited

U.S. PATENT DOCUMENTS 2,720,041 A * 10/1955 Kajtar ..... A43B 7/06 36/3 B
3,533,171 A * 10/1970 Tomiharu ..... A43B 13/184 36/3 B
4,071,963 A * 2/1978 Fukuoka ..... A43B 7/06 36/3 B
4,438,573 A * 3/1984 McBarron ..... A43B 13/181 36/29
4,912,858 A * 4/1990 Mochizuki ..... A43B 7/06 36/3 B
4,939,851 A * 7/1990 Miller ..... A43B 5/08 36/3 R
2001/0025432 A1* 10/2001 Contreras ..... A43B 7/08 36/43
2024/0114995 A1* 4/2024 Jolley ..... A43B 13/04
2024/0122294 A1* 4/2024 Zheng ..... A43B 7/32

* cited by examiner

*Primary Examiner* — Ted Kavanaugh
(74) *Attorney, Agent, or Firm* — Scully, Scott, Murphy & Presser, P.C.

(57) ABSTRACT

A waterproof, breathable, and shock-absorbing shoe sole. The shoe sole includes a midsole and an outsole compositing at the lower end of the midsole. A cavity and a spiral channel corresponding to the cavity are provided between the midsole and the outsole, and the spiral channel expands from the edge of the cavity from inside to outside to connect with the outside. The top wall of the cavity is provided with a through-hole. There is a cavity between the midsole and outsole.

5 Claims, 5 Drawing Sheets

WATERPROOF, BREATHABLE, AND SHOCK-ABSORBING SHOE SOLE

TECHNICAL FIELD

The present application relates to the field of shoe soles, particularly to a waterproof, breathable, and shock-absorbing shoe sole.

BACKGROUND TECHNOLOGY

Shoes, as a daily necessity for people, serve functions such as warmth, protection, and aesthetics. At present, conventional shoe soles generally have poor shock absorption performance. When walking or exercising, they cannot effectively cushion the impact force from the ground, which can easily cause foot fatigue and even affect joint health; their poor breathability makes it difficult for the air inside the shoes to circulate. Long term wearing can easily make the feet damp, breed bacteria, produce odors, and reduce wearing comfort. Moreover, most traditional shoe soles lack waterproof structures, and when exposed to water or humid environments, moisture can easily seep into the shoes, wetting the feet and affecting the usage scenario and experience. Therefore, it is necessary to develop improved shoe soles to solve the above problems.

SUMMARY

The present application provides a waterproof, breathable, and shock-absorbing shoe sole to solve the problems of poor shock-absorbing performance, poor breathability, and lack of waterproof structure in existing shoe soles.

The following technical solution is adopted in the present application:

A waterproof, breathable, and shock-absorbing shoe sole, comprising a midsole and a outsole compositing at the lower end of the midsole. A cavity and a spiral channel corresponding to the cavity are provided between the midsole and the outsole, and the spiral channel has an inner end connecting the cavity and an outer end connecting the outside, the spiral channel expands from the inner end to the outer end. The cavity has a top wall which is provided with a through-hole. In some embodiments, the shoe sole is provided with several such combinations of cavity and spiral channel, which realize the water proof, shock absorbing and breathable functions in different portions of the shoe sole. In some embodiments, the several such combinations are set at the front portion of the shoe sole. Furthermore, there are vent grooves distributed on the upper surface of the midsole, the vent grooves are connected in a staggered manner as a whole, and the upper end of the through-hole is located at the bottom of the vent grooves.

Furthermore, the bottom wall of the cavity protrudes downward in a hemispherical shape.

Furthermore, the through-hole has a inner diameter of 2.0 mm to 4.0 mm, preferably, 3.0 mm.

Furthermore, the midsole is made of EVA or TPU material, or the midsole is made of supercritical foam material.

Furthermore, the lower surface of the outsole is provided with anti-slip patterns, and the material of the outsole is rubber or TPU, preferably rubber.

From the above description of the structure of the present application, it can be seen that compared with the prior art, the present application has the following advantages:

1. There is a cavity between the midsole and outsole of this application, which can efficiently buffer the impact force of the ground, greatly reduce the force acting on the feet during walking and exercise, relieve fatigue, provide better protection for joints, and improve the comfort and safety of exercise and daily walking.

2. By matching the cavity with spiral channel and providing a through hole on the top wall of the cavity, the shoe sole of the present application established a good air circulation channel, accelerate air exchange inside the shoe, keep the feet dry, inhibit bacterial growth and odor generation, and maintain a comfortable experience even after long-term wear.

3. There is a spiral channel between the midsole and outsole in this application, which is the unique waterproof structure design that effectively blocks water penetration. In damp, water wading and other scenarios, it can keep the inside of the shoe dry, broaden the usage scenarios, improve the environment adaptability of the shoe sole, optimize the performance of the shoe sole in all aspects, and meet the diverse needs of users.

Figure 1:
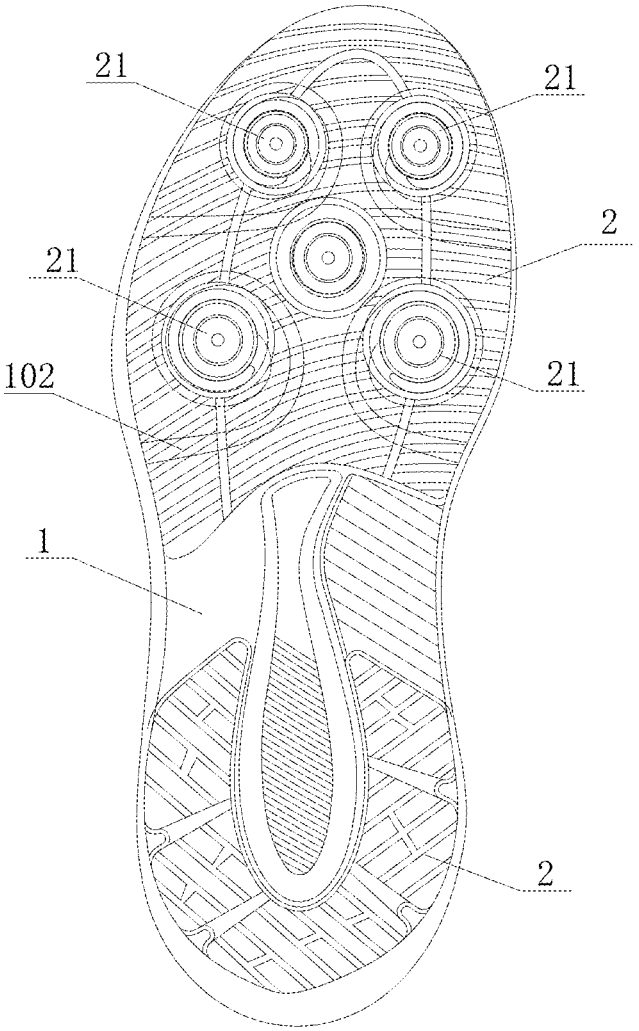
FIG. 1 is a schematic diagram of a bottom view structure of the shoe sole of the present application

Among them, 1. Midsole; 10. Cavity; 11. Vent groove; 101. Through-hole; 102. Spiral channel; 1021 inner end; 1022 outer end; 2. Outsole; 21. Bottom wall of the cavity.

EMBODIMENTS

The specific embodiments of the present application will be described below with reference to the accompanying drawings.

Referring to FIGS. 1-5, a waterproof, breathable, and shock-absorbing shoe sole comprises a midsole 1 and an outsole 2 compositing at the lower end of the midsole 1. A cavity 10 and a spiral channel 102 corresponding to the cavity 10 are provided between the midsole 1 and the outsole 2. The spiral channel 102 has an inner end 1021 connecting the cavity and an outer end 1022 connecting the outside, the spiral channel 102 expands from the inner end 1021 to the outer end 1022. The cavity 10 is connected to the outside of the shoe sole through the spiral channel 102, and the top wall of the cavity 10 is provided with a through-hole 101, through which the cavity 10 is connected to the shoe cavity.

Figure 3:
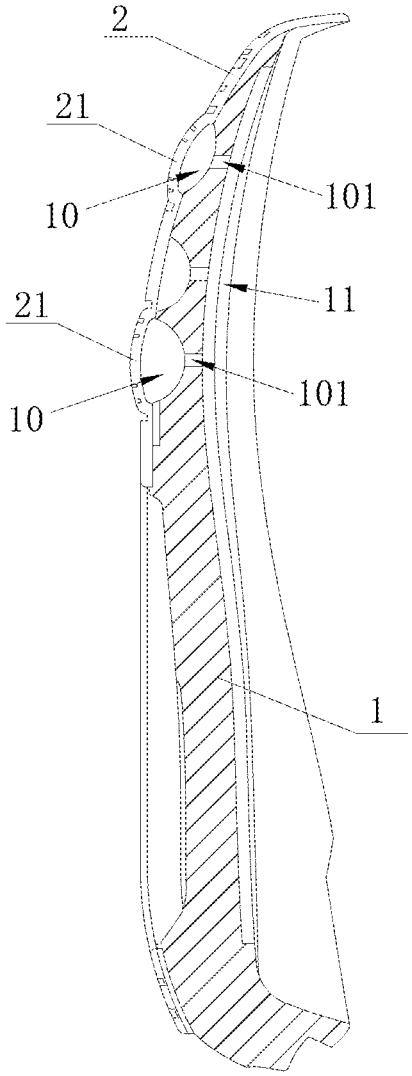
FIG. 3 is the cross-sectional view of the midsole of the present application.
Figure 4:
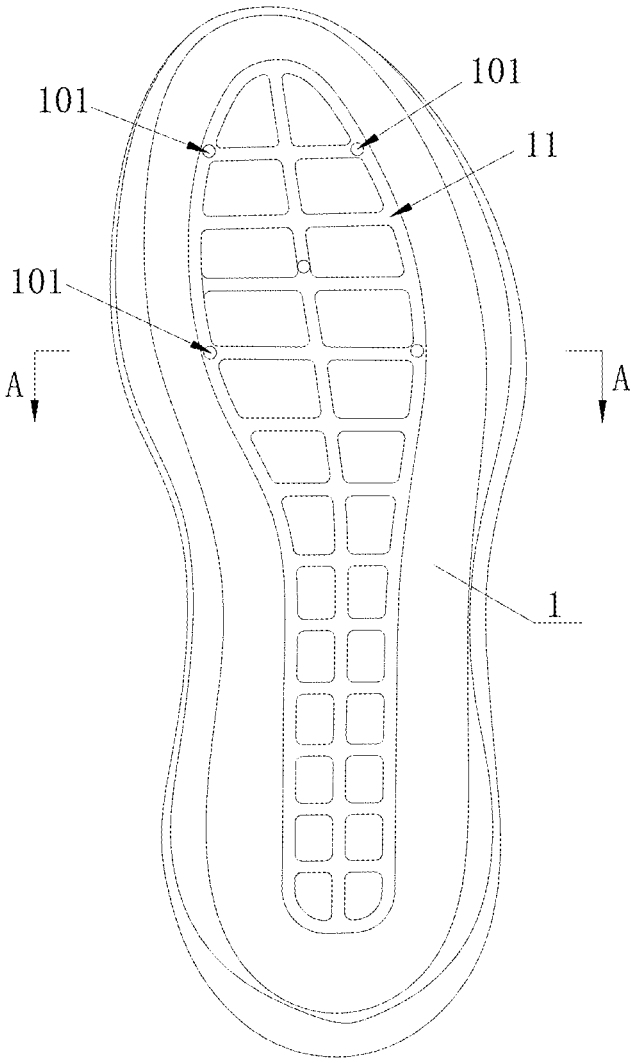
FIG. 4 is a schematic diagram of the top view of the shoe sole of the present application.
Figure 5:
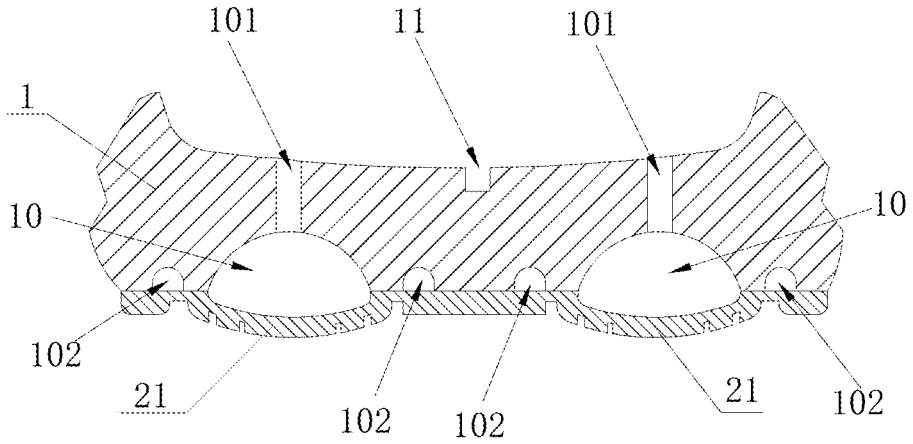
FIG. 5 is the cross-sectional view of the shoe sole of the present application along the A-A direction in FIG. 4.

Referring to FIGS. 3 and 4, the upper surface of the midsole 1 is distributed with vent grooves 11 which are connected in a staggered manner as a whole. The upper end of the through-hole 101 is located at the bottom of the vent grooves 11, and the vent grooves 11 increases the breathability of the surface of the midsole 1, so that when the foot steps on the midsole 1, it can maintain good breathability.

Referring to FIG. 3, the bottom wall 21 of the cavity protrudes downward in a hemispherical shape. When the shoe sole touches the ground, the bottom wall 21 of the cavity is compressed and flattened by the ground. The air inside the cavity 10 synchronously blows towards the through-hole 101 and the spiral channel 102, making it difficult for accumulated water on the ground to enter the shoe sole along the spiral channel 102. When the bottom wall 21 of the cavity is subjected to a brief impact, the air inside the cavity 10 synchronously blows towards the through-hole 101 and the spiral channel 102 for a delay, which enhances the shock-absorbing function of the shoe sole by the cavity 10.

Figure 2:
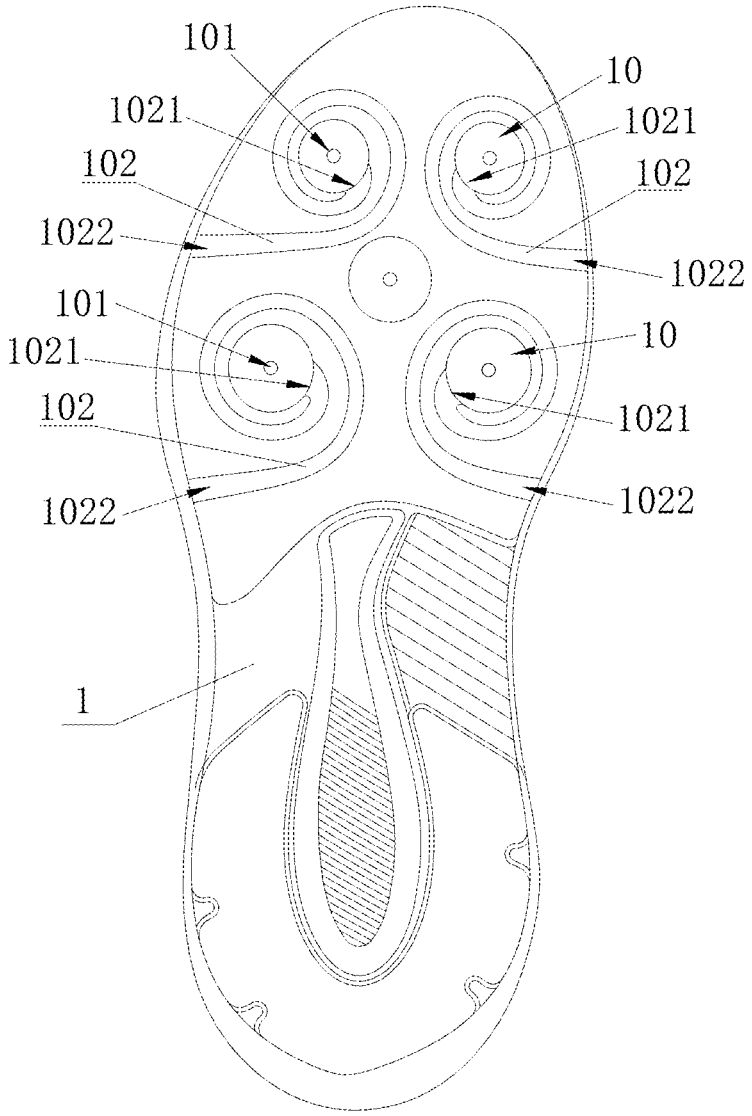
FIG. 2 is a schematic diagram of a top view structure of a midsole of the present application.

Referring to FIGS. 2 and 3, the curvature radius of the spiral channel 102 decreases from the outer end 1022 to the inner end 1021, and the tension force on the inner wall of the spiral channel 102 increases from the outer end 1022 to the inner end 1021. When gas or water flows along the spiral channel 102 from the outer end 1022 toward the inner end 1021, the rotational resistance will increase. The mass of the water flow is greater than that of the gas, and the interaction force between the water flow and the inner wall of the spiral channel 102 is much greater than that between the gas and the inner wall of the spiral channel 102. The water flow will stop at the outer circle of the spiral channel 102, while the gas can rotate inward to the inner circle of the spiral channel 102 and enter the shoe through the breathable hole. Therefore, the waterproof breathable and shock-absorbing shoe sole can effectively balance breathability and waterproofing.

The through-hole 101 has an inner diameter of 2.0 mm to 4.0 mm, preferably, the through-hole 101 has an inner diameter of 3.0 mm.

The above-mentioned midsole 1 is made of EVA or TPU material, and preferably the above-mentioned midsole 1 is made of EVA material, which is soft and elastic.

The lower surface of the above-mentioned outsole 2 is provided with anti-slip patterns, which enhance the anti-slip function of the shoe sole. The material of outsole 2 is rubber or TPU, with rubber being the preferred material.

The above is only a specific embodiment of the present application, but the design concept of the present application is not limited to this. Any non substantial modification of the present application using this concept should be considered as an infringement of the scope of protection of the present application.

The invention claimed is:

1. A waterproof, breathable, and shock-absorbing shoe sole comprising a midsole and an outsole compositing at a lower end of the midsole, characterized in that a cavity and a spiral channel corresponding to the cavity are provided between the midsole and the outsole, and the spiral channel has an inner end connecting the cavity and an outer end connecting an outside, the spiral channel expands from the inner end to the outer end, the cavity has a top wall which is provided with a through-hole, a bottom wall of the cavity protrudes downward in a hemispherical shape, when the shoe sole touches the ground, the bottom wall of the cavity is compressed and flattened by the ground, air inside the cavity is synchronously blown towards the through-hole and the spiral channel, making it difficult for accumulated water on the ground to enter the shoe sole along the spiral channel.

2. The shoe sole according to claim 1, wherein an upper surface of the midsole is distributed with vent grooves which are connected in a staggered manner as a whole, and an upper end of the through-hole is located at a bottom of the vent grooves.

3. The shoe sole according to claim 1, wherein the through-hole has an inner diameter of 2.0 mm to 4.0 mm.

4. The shoe sole according to claim 1, wherein the midsole is made of EVA material or supercritical foam material.

5. The shoe sole according to claim 1, wherein a lower surface of the outsole is provided with anti-slip patterns.

* * * * *